US009856684B2

(12) United States Patent
Sidwell

(10) Patent No.: US 9,856,684 B2
(45) Date of Patent: Jan. 2, 2018

(54) SLIDING DOOR GUIDE SYSTEM

(71) Applicant: William Edward Sidwell, Valley Park, MO (US)

(72) Inventor: William Edward Sidwell, Valley Park, MO (US)

( * ) Notice: Subject to any disclaimer, the term of this patent is extended or adjusted under 35 U.S.C. 154(b) by 0 days.

(21) Appl. No.: 15/095,320

(22) Filed: Apr. 11, 2016

(65) Prior Publication Data

US 2017/0292304 A1 Oct. 12, 2017

(51) Int. Cl.
*E05D 13/00* (2006.01)
*E05D 15/06* (2006.01)

(52) U.S. Cl.
CPC ..... *E05D 15/0656* (2013.01)

(58) Field of Classification Search
CPC .... E05D 15/0656; Y10T 16/361; Y10T 16/37
USPC ..... 49/410, 411, 412; 160/197, 222
See application file for complete search history.

(56) References Cited

U.S. PATENT DOCUMENTS 2,833,346 A * 5/1958 Preston ..... E06B 3/4654 160/197
3,975,862 A 8/1976 Doan
4,014,070 A * 3/1977 Rifkin ..... A47K 3/34 16/90
4,281,435 A 8/1981 Winter et al.
4,455,709 A * 6/1984 Zanini ..... E05D 15/0656 16/90
4,785,485 A * 11/1988 Etesam ..... A47K 3/34 4/557
D299,967 S 2/1989 Litchfield et al.
5,724,770 A 3/1998 McAfee
5,832,980 A * 11/1998 Cianciolo ..... E05D 15/58 160/197
5,852,837 A * 12/1998 Husting ..... A47K 3/34 4/607
7,059,017 B1 6/2006 Rosko
7,458,410 B1 * 12/2008 Bronner ..... E05D 15/0656 160/197
7,506,727 B2 3/2009 Spiess
9,410,356 B2 * 8/2016 Yuhas ..... E06B 3/4636
2010/0242370 A1 * 9/2010 Trulaske, Sr. ..... E05D 13/14 49/410
2015/0164284 A1 * 6/2015 Sprague ..... E05D 15/0686 49/411

* cited by examiner

*Primary Examiner* — Jerry Redman

(57) ABSTRACT

A sliding door guide system for replacing a traditional floor track for sliding doors includes a first sliding door that is suspended from a support. A second sliding door is suspended from a support. The second sliding door is aligned with the first sliding door. A guide is coupled to the first sliding door. The guide slidably engages the second sliding door. Thus, the second sliding door is retained at a position relative to the first sliding door.

4 Claims, 3 Drawing Sheets

SLIDING DOOR GUIDE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to guide devices and more particularly pertains to a new guide device for replacing a traditional floor track for sliding doors.

BRIEF SUMMARY OF THE INVENTION

An embodiment of the disclosure meets the needs presented above by generally comprising a first sliding door that is suspended from a support. A second sliding door is suspended from a support. The second sliding door is aligned with the first sliding door. A guide is coupled to the first sliding door. The guide slidably engages the second sliding door. Thus, the second sliding door is retained at a position relative to the first sliding door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
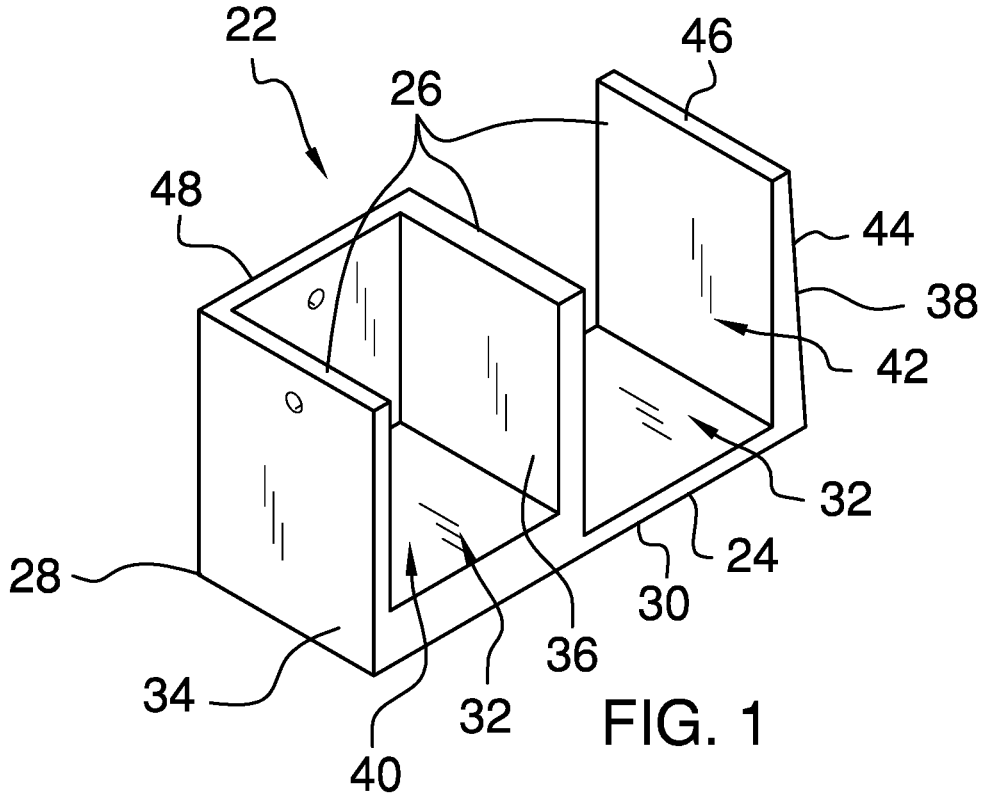
FIG. 1 is a front perspective view of a sliding door guide system according to an embodiment of the disclosure.
Figure 2:
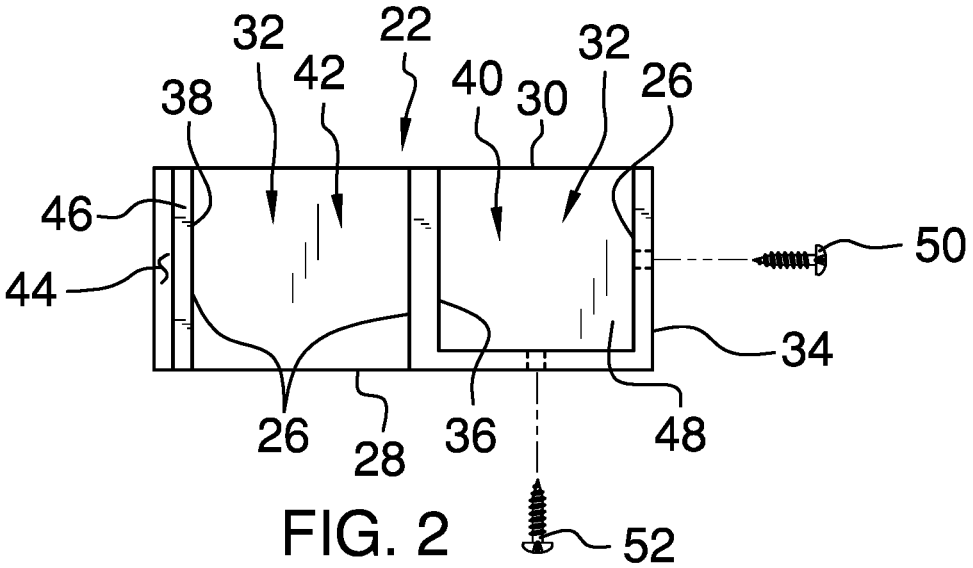
FIG. 2 is a top view of an embodiment of the disclosure.
Figure 3:
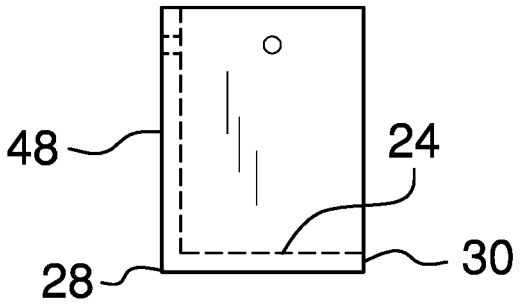
FIG. 3 is a right side view of an embodiment of the disclosure.
Figure 4:
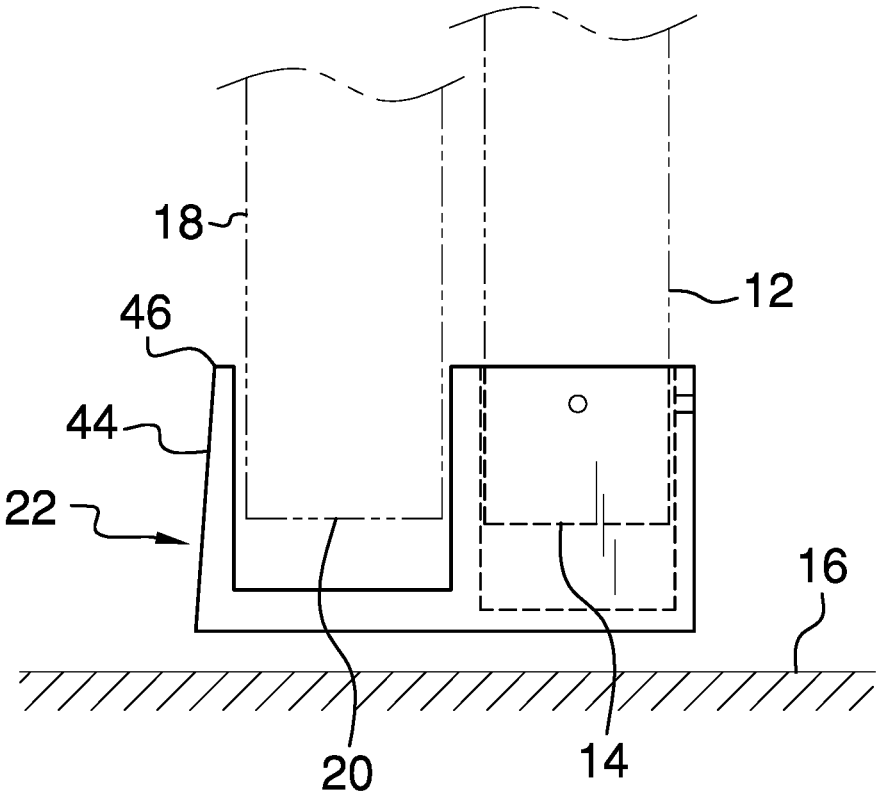
FIG. 4 is a front phantom view of an embodiment of the disclosure.
Figure 5:
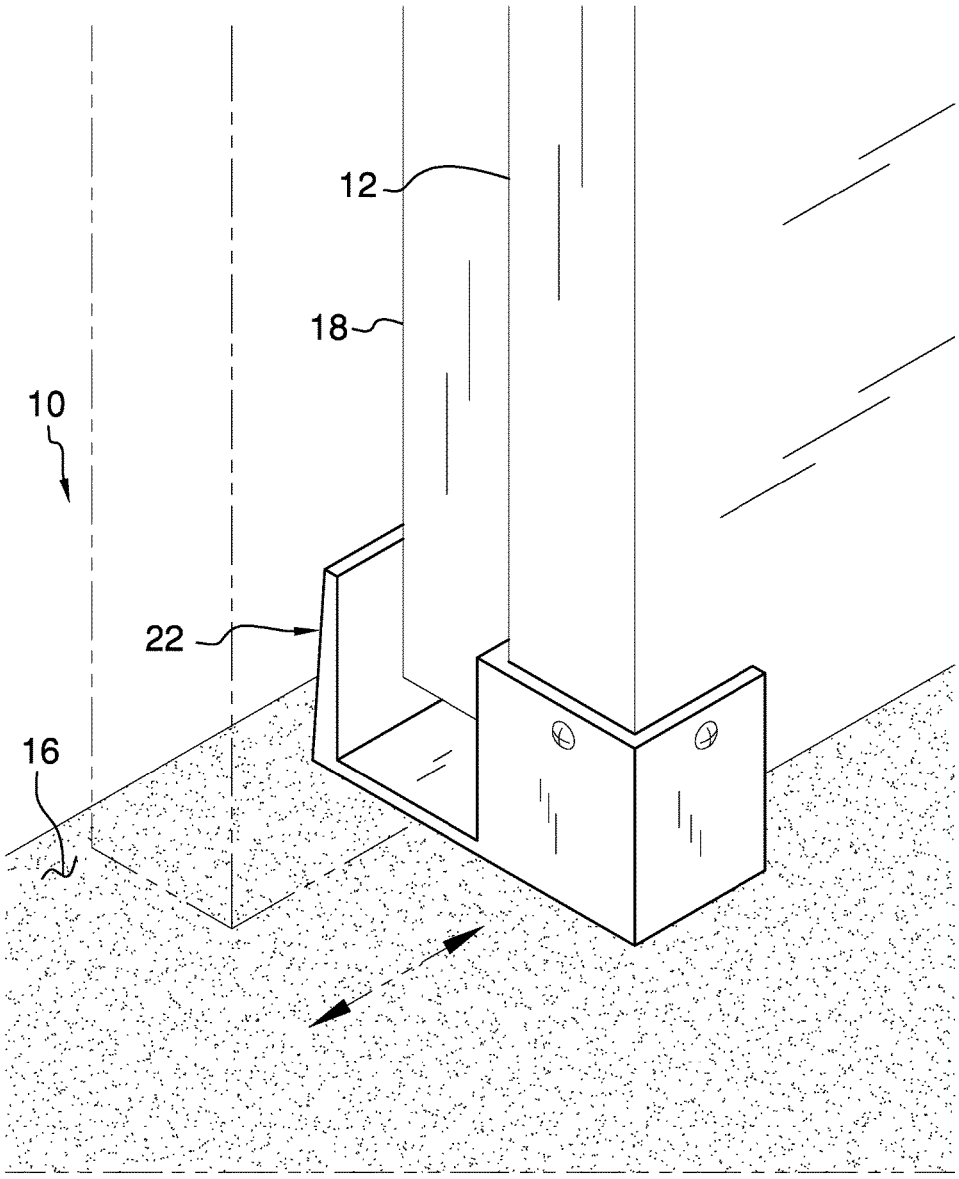
FIG. 5 is a perspective in-use view of an embodiment of the disclosure.

With reference now to the drawings, and in particular to FIGS. 1 through 5 thereof, a new guide device embodying the principles and concepts of an embodiment of the disclosure and generally designated by the reference numeral 10 will be described.

As best illustrated in FIGS. 1 through 5, the sliding door guide system 10 generally comprises a first sliding door 12 that is suspended from a support. The first sliding door 12 has a bottom edge 14 that may be spaced from a support surface 16. The first sliding door 12 may be a sliding closet door or the like. A second sliding door 18 is suspended from the support. The second sliding door 18 is aligned with the first sliding door 12. The second sliding door 18 has a lower edge 20 that may be spaced from the support surface 16. The support surface 16 may be a floor or the like.

A guide 22 is coupled to the first sliding door 12 and the guide 22 slidably engages the second sliding door 18. Thus, the second sliding door 18 is retained at a selected spacing with respect to the first sliding door 12. The guide 22 has a basal wall 24 and a plurality of vertical walls 26. The basal wall 24 has a first edge 28 and a second edge 30.

Each of the vertical walls 26 is coupled to and extends upwardly from the basal wall 24. Each of the vertical walls 26 extends between the first edge 28 and the second edge 30. The vertical walls 26 are spaced apart from each other. Thus, the vertical walls 26 define a pair of spaces 32 between the vertical walls 26.

The plurality of vertical walls 26 includes a first vertical wall 34, a second vertical wall 36 and a third vertical wall 38. The pair of spaces 32 includes a first space 40 between the first vertical wall 34 and the second vertical wall 36. Moreover, the pair of spaces 32 includes a second space 42 between the second vertical wall 36 and the third vertical wall 38.

The third vertical wall 38 has an outwardly facing surface 44 and a distal edge 46 with respect to the basal wall 24. The outwardly facing 44 surface tapers inwardly between the basal wall 24 and the distal edge 46. A stop 48 extends between the first vertical wall 34 and the second vertical wall 36. The stop 48 is aligned with the first edge 28 of the basal wall 24. The basal wall 24 corresponding to the first space 40 has a thickness that is greater than a thickness of the basal wall 24 corresponding to the second space 42.

The bottom edge 14 of the first sliding door 12 is positioned in the first space 40 having the first sliding door 12 abutting the stop 48. The lower edge 20 of the second sliding door 18 is positioned in the second space 42. Thus, the second sliding door 18 selectively slides through the second space 42. The guide 22 is spaced from the support surface 16 when the guide 22 is positioned on the first sliding door 12. Thus, the support surface 16 may be cleaned beneath the first sliding door 12 and the second sliding door 18.

A first fastener 50 extends through the first vertical wall 34 and engages the first sliding door 12. Thus, the guide 22 is coupled to the first sliding door 12. A second fastener 52 extends through the stop 48 and engages the first sliding door 12. Thus, the guide 22 is coupled to the first sliding door 12. Each of the first fastener 50 and the second fastener 52 may comprise a screw or the like. The guide 22 serves as a replacement for a traditional sliding door track mounted to the support surface 16.

In use, the traditional sliding door track is removed from the support surface 16. The bottom edge 14 of the first sliding door 12 is positioned in the first space 40. Each of the first fastener 50 and the second fastener 52 are manipulated to couple the guide 22 to the first sliding door 12. The guide 22 is oriented on the first sliding door 12 to facilitate the second sliding door 18 to slide in the second space 42. Thus, the second sliding door 18 is retained at the selected spacing from the first sliding door 12. Additionally, the basal wall 24 of the guide 22 is spaced from the support surface 16 when the guide 22 is coupled to the first sliding door 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sliding door guide system comprising:

a first sliding door being suspended from a support, said first sliding door having a bottom edge being configured to be spaced from a support surface;

a second sliding door being suspended from a support, said second sliding door being aligned with said first sliding door, said second sliding door having a lower edge being configured to be spaced from a support surface; and a guide being coupled to said first sliding door, said guide slidably engaging said second sliding door such that said second sliding door is retained at a position relative to said first sliding door, said guide having a basal wall and a plurality of vertical walls, said basal wall having a first edge and a second edge, each of said vertical walls being coupled to and extending upwardly from said basal wall, each of said vertical walls extending between said first edge and said second edge, said vertical walls being spaced apart from each other to define a pair of spaces between said vertical walls, said vertical walls including a first vertical wall, a second vertical wall and a third vertical wall, said pair of spaces including a first space between said first vertical wall and said second vertical wall, said pair of spaces including a second space between said second vertical wall and said third vertical wall, said guide having a stop extending between said first vertical wall and said second vertical wall, said stop being aligned with said first edge of said basal wall, said bottom edge of said first sliding door being positioned in said first space having said first sliding door abutting said stop, said lower edge of said second sliding door being positioned in said second space such that said second sliding door selectively slides through said second space.

2. The system according to claim 1, wherein said third vertical wall has an outwardly facing surface and a distal edge with respect to said basal wall, said outwardly facing surface tapering inwardly between said basal wall and said distal edge.

3. The system according to claim 1, further comprising:

a first fastener extending through said first vertical wall and engaging said first sliding door such that said guide is coupled to said first sliding door; and a second fastener extending through said stop and engaging said first sliding door such that said guide is coupled to said first sliding door.

4. A sliding door guide system comprising:

a first sliding door being suspended from a support, said first sliding door having a bottom edge being configured to be spaced from a support surface;

a second sliding door being suspended from a support, said second sliding door being aligned with said first sliding door, said second sliding door having a lower edge being configured to be spaced from a support surface;

a guide being coupled to said first sliding door, said guide slidably engaging said second sliding door such that said second sliding door is retained at a position relative to said first sliding door, said guide having a basal wall and a plurality of vertical walls, said basal wall having a first edge and a second edge, each of said vertical walls being coupled to and extending upwardly from said basal wall, each of said vertical walls extending between said first edge and said second edge, said vertical walls being spaced apart from each other to define a pair of spaces between said vertical walls, said vertical walls including a first vertical wall, a second vertical wall and a third vertical wall, said pair of spaces including a first space between said first vertical wall and said second vertical wall, said pair of spaces including a second space between said second vertical wall and said third vertical wall, said third vertical wall having an outwardly facing surface and a distal edge with respect to said basal wall, said outwardly facing surface tapering inwardly between said basal wall and said distal edge, said guide having a stop extending between said first vertical wall and said second vertical wall, said stop being aligned with said first edge of said basal wall, said bottom edge of said first sliding door being positioned in said first space having said first sliding door abutting said stop, said lower edge of said second sliding door being positioned in said second space such that said second sliding door selectively slides through said second space;

a first fastener extending through said first vertical wall and engaging said first sliding door such that said guide is coupled to said first sliding door; and a second fastener extending through said stop and engaging said first sliding door such that said guide is coupled to said first sliding door.

* * * * *